US012638185B2

(12) United States Patent
Clemen

(10) Patent No.: US 12,638,185 B2
(45) Date of Patent: May 26, 2026

(54) INJECTOR ASSEMBLY FOR A GAS TURBINE AND AIRCRAFT

(71) Applicant: ROLLS-ROYCE DEUTSCHLAND LTD & CO KG, Blankenfelde-Mahlow (DE)

(72) Inventor: Carsten Clemen, Mittenwalde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 0 days.

(21) Appl. No.: 19/078,713

(22) Filed: Mar. 13, 2025

(65) Prior Publication Data

US 2025/0297739 A1 Sep. 25, 2025

(30) Foreign Application Priority Data

Mar. 19, 2024 (DE) ..... 10 2024 202 602.6

(51) Int. Cl.
*F23R 3/36* (2006.01)
*F23D 14/60* (2006.01)
(Continued)

(52) U.S. Cl.
CPC ..... *F23R 3/36* (2013.01); *F23D 14/60* (2013.01); *F23D 17/002* (2013.01); *F23R 3/10* (2013.01);
(Continued)

(58) Field of Classification Search
CPC .. F02C 9/40; F02C 9/263; F02C 7/232; F02C 3/22; F23R 3/36; F23R 3/34–346;
(Continued)

(56) References Cited

U.S. PATENT DOCUMENTS 4,463,568 A * 8/1984 Willis ..... F23D 17/002 239/432
5,184,457 A * 2/1993 Hseu ..... F02C 9/263 60/734
(Continued)

FOREIGN PATENT DOCUMENTS

DE 2910464 A1 9/1979
DE 3228025 A1 2/1983
(Continued)

OTHER PUBLICATIONS

European Search Report dated Jun. 3, 2025 from counterpart European App No. 25156741.
(Continued)

*Primary Examiner* — Stephanie Sebasco Cheng
(74) *Attorney, Agent, or Firm* — SHUTTLEWORTH & INGERSOLL, PLC; Timothy J. Klima

(57) ABSTRACT

An injector assembly for a gas turbine for introducing a gaseous fuel, liquid fuel and air into a combustion chamber, includes an injector shaft and an injector main body aligned along an injector longitudinal axis. The injector main body includes a first gas duct arranged centrally on the injector longitudinal axis, for introducing a gas flow into the combustion chamber; an air duct arranged radially around the outside of the first gas duct, and a liquid fuel injection arranged radially around the first gas duct for introducing the liquid fuel into the combustion chamber. The injector assembly introduces the gaseous fuel. The injector assembly is switchable between two configurations during operation: in a first configuration, air flows through the first gas duct, as an air injection; in a second configuration, the gaseous fuel flows through, as a gas fuel injection.

18 Claims, 6 Drawing Sheets

Figure 1:
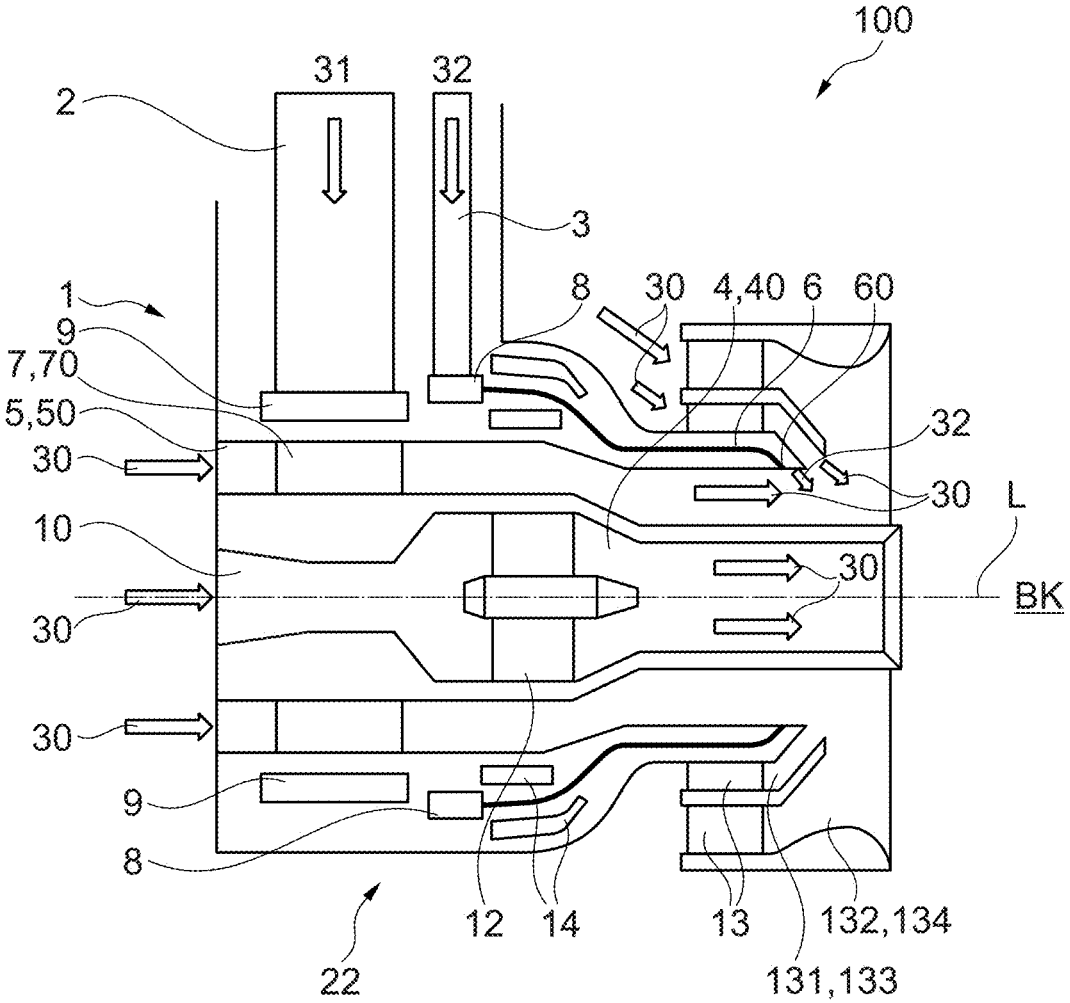

(51) Int. Cl.

| | |
|---|---|
| ***F23D 17/00*** | (2006.01) |
| ***F23R 3/10*** | (2006.01) |
| ***F23R 3/26*** | (2006.01) |
| ***F23R 3/28*** | (2006.01) |

(52) U.S. Cl.
CPC ..... *F23R 3/26* (2013.01); *F23R 3/28* (2013.01); *F23D 2204/10* (2013.01); *F23D 2900/14004* (2013.01); *F23D 2900/14381* (2013.01); *F23D 2900/14481* (2013.01)

(58) Field of Classification Search
CPC .... F23R 3/286; F23R 3/12; F23R 3/14; F23R 3/20; F23R 3/22; F23R 3/26; F23R 3/28; F23R 2900/003343; F23R 2900/00004; F23D 17/002; F23D 2204/10; F23D 2900/14; F23D 2900/14002; F23D 2900/14003; F23D 2900/14004; F23D 2900/14041–14042; F23D 2900/14064; F23D 2900/14642; F23D 2900/14681; F23D 2900/00008; F23D 2900/31019; F23D 2900/00016; F23D 2900/14021; F23D 2900/14241; F23D 2900/14701; F23D 2900/14381; F23D 2900/14481; F23D 14/82; F23D 14/825; F23D 14/02–105; F23D 14/32; F23D 14/62–64; F23D 2203/007
See application file for complete search history.

(56) References Cited

U.S. PATENT DOCUMENTS

| | | | | |
|---|---|---|---|---|
| 6,434,945 | B1 * | 8/2002 | Mandai | F23R 3/36 60/39.463 |
| 7,921,650 | B2 | 4/2011 | Oda | |
| 9,400,113 | B2 * | 7/2016 | Ogata | F23R 3/286 |
| 9,835,089 | B2 * | 12/2017 | Zuo | F02C 7/222 |
| 10,100,748 | B2 * | 10/2018 | Kawai | F02C 9/40 |
| 2006/0191268 | A1 | 8/2006 | Widener | |
| 2014/0137565 | A1 | 5/2014 | Twardochleb | |
| 2017/0089582 | A1 | 3/2017 | Carrotte | |

FOREIGN PATENT DOCUMENTS

| | | | |
|---|---|---|---|
| DE | 102009059222 | A1 | 7/2010 |
| DE | 102022201182 | A1 | 8/2023 |
| EP | 0761946 | A1 | 3/1997 |
| EP | 0806558 | A2 | 11/1997 |
| EP | 2372241 | A1 | 10/2011 |
| EP | 4265898 | A1 | 10/2023 |

OTHER PUBLICATIONS

German Search Report dated Nov. 29, 2024 from counterpart German App No. 10 2024 202 602.6.

* cited by examiner

INJECTOR ASSEMBLY FOR A GAS TURBINE AND AIRCRAFT

This application claims priority to German Patent Application 102024202602.6 filed Mar. 19, 2024, the entirety of which is incorporated by reference herein.

The invention relates to an injector assembly for a gas turbine, in particular an engine of an aircraft, for introducing a gaseous fuel and a liquid fuel as well as air into a combustion chamber, with an injector shaft and an injector main body aligned along an injector longitudinal axis, wherein the injector main body comprises:

- a first gas duct arranged centrally on the injector longitudinal axis for introducing a gas flow into the combustion chamber,
- at least one air duct arranged radially around the outside of the first gas duct and
- a liquid fuel injector arranged radially around the first gas duct for introducing the liquid fuel into the combustion chamber,
- wherein the injector assembly is also set up to introduce the gaseous fuel. The invention also relates to an aircraft with an injector assembly.

An injector assembly of the type mentioned at the outset is described, for example, in DE 10 2022 201 182 A1. A fuel injection for the gaseous fuel is arranged radially on the outside around a central air duct arranged on a longitudinal nozzle axis and a liquid fuel injection.

The invention addresses the problem of providing an injector assembly of the type mentioned at the outset and an aircraft with optimized emission characteristics.

For the injector assembly and for the aircraft, the problem is solved by the features disclosed herein.

With regard to the injector assembly, it is provided that this is designed to assume (optionally or depending on operation), in particular two, alternative configurations between which the injector assembly can be switched during operation, wherein in a first configuration air can flow through the first gas duct, in the function of air injection, and in a second configuration the gaseous fuel can flow through, in the function of gas fuel injection.

The injector assembly preferably has only the first gas duct as the gas fuel injection in the second configuration, and no other gas fuel injection.

In the first configuration, the injector assembly can be operated in a separate mode exclusively with the liquid fuel and does not have the gaseous fuel flowing through it into the combustion chamber.

In the second configuration, the injector assembly can be operated both exclusively by gaseous fuel (without liquid fuel) and simultaneously in a combined operation with both the gaseous fuel and the liquid fuel flowing through it, and not exclusively with the liquid fuel.

In particular, the gaseous fuel is formed from hydrogen or contains hydrogen. The liquid fuel is formed in particular by kerosene and/or a sustainable alternative fuel (SAF).

The changeover is preferably carried out by switching on and/or switching off the flow of gaseous fuel (by applying or reducing an overpressure relative to the air pressure prevailing in the combustion chamber), in particular by opening and/or closing a fuel valve for the gaseous fuel inside the fuel peripheral of the aircraft, outside the injector assembly.

In a preferred variant, the first gas duct comprises an air inflow opening in an upstream end portion, which is arranged in particular centrally on the injector longitudinal axis (i.e. coaxially with the portion of the first gas duct extending downstream thereof). At least one, preferably two, gas fuel transfer line(s) is/are arranged within (in particular exclusively) the injector main body and runs/run between a gas fuel supply line, in particular between a gas fuel ring reservoir arranged downstream of the gas fuel supply line, and the first gas duct, in particular radially (or radially-axially). In the first configuration, the gas fuel transfer line(s) is/are closed (i.e. the gaseous fuel cannot flow through) and the air inlet is open (i.e. air can flow through). In the second configuration, the air inlet port is closed (i.e. air cannot flow through) and the gas fuel transfer line(s) is/are open (i.e. the gaseous fuel can flow through). In particular, only air (in the first configuration) can flow through the upstream end portion. In particular, the gas fuel ring reservoir is arranged in the injector main body in a ring around the first gas duct (with the second gas duct arranged in between).

Preferably, at least one closing body, preferably two, closing bodies is/are present for switching between the configurations, which in the first configuration is/are displaced (in particular inserted) radially into the gas fuel transfer line(s) (outside the first gas duct) to close the gas fuel transfer line(s) while releasing the air inflow opening and in the second configuration is/are positioned radially centrally in or downstream of the air inflow opening in the first gas duct to close the air inflow opening while releasing the gas fuel transfer line(s).

It is expedient to provide that a closing body duct is arranged in the at least one closing body for the gaseous fuel to flow through, which duct is arranged so that no flow can pass through in the first configuration and a flow can pass through in the second configuration, in particular by means of the positioning of the closing body/closing bodies. In particular, the closing body duct can be aligned with an upstream portion parallel to the corresponding gas fuel transfer line and with a downstream portion parallel to the first gas duct. In the second configuration, the closing body duct thus forms a flow connection between the (possibly respective) gas fuel transfer line and the first gas duct. In the first configuration, for example, the downstream portion of the closing body duct is closed at its downstream end by means of an inner wall of the gas fuel transfer line.

For automated control of the changeover between the configurations using mechanical forces, in particular without the effect of electrical actuating signals within the injector assembly, at least one resilient actuating element is preferably provided for the changeover between the configurations, which effects the changeover between the first configuration and the second configuration by means of spring force in interaction with a pressure force applied by the gaseous fuel. The actuating element is designed in particular as a helical compression spring. The changeover can thus be made by switching the flow of gaseous fuel on and off outside the injector assembly and automatically adjusting the corresponding configuration of the injector assembly.

The first configuration, for example, forms a resting state in which the actuating element is in the resting position without counteracting the pressure force. In the second configuration, the actuating element is adjusted by counteracting the pressure force.

Preferably, the actuating element is arranged on the at least one closing body, in particular attached to it. Advantageously, the actuating element can be securely mounted and/or guided on or in the closing body by means of a recess (in each case, if applicable) in the closing body. In particular, the actuating element is fully inserted into the recess(es) when pushed together. If two closing bodies are present, the recesses are preferably in the same axial position, wherein they form a cavity for receiving the actuating element when the closing bodies are pushed together.

In a particularly favourable variant, two closing bodies and two gas-fuel transfer lines are arranged opposite each other (in the direction of rotation) in the direction of rotation with respect to the injector longitudinal axis (i.e. one gas-fuel transfer line with an associated closing body opposite the other pairing), wherein one end of the actuating element is attached to one of the closing bodies in each case. In the first configuration the closing bodies are displaced, i.e. are pushed (at least largely, in particular completely), pressed radially apart into the gas-fuel transfer lines by means of the actuating element while releasing the air inflow opening, and/or in the second configuration the closing bodies are pressed or pushed together radially against the spring force of the actuating element by means of the pressure force of the gaseous fuel, wherein the closing bodies are positioned centrally within the first gas duct in contact with one another (while closing the air inflow opening). The respective closing bodies are preferably mounted and guided for radial displacement in the respective gas fuel transfer lines, wherein at least one radially outward-facing portion of the respective closing body projects permanently into the respective gas fuel transfer line. The gas fuel transfer lines with the respective associated closing bodies can, for example, be arranged at a position of 90° in the direction of rotation and at 270° relative to the position of the injector shaft. In the first configuration, the closing body duct is closed, in particular in cooperation with the inner wall of the (respective) gas fuel transfer line, so that the respective closing body acts as a closure of the gas fuel transfer lines.

Advantageous installation options arise if the first gas duct has the smallest flow cross-section, in particular the smallest diameter, at the axial position of the closing body/bodies. In this context, the presence of two closing bodies is particularly advantageous. In this way, the closing bodies can be pushed through the air inflow opening into the first gas duct or onto the gas fuel transfer lines during installation.

An advantageous flow characteristic can be obtained by means of the injector assembly if the air duct is formed as a second gas duct running radially directly (i.e. without the intermediate arrangement of a further fluid duct) around the first gas duct (in other words, a second gas duct is formed as an air duct radially directly around the first gas duct), wherein its upstream end, for example, is positioned at least substantially at the axial position of the upstream end of the air inflow opening.

Advantages, in particular with regard to assembly, arise if the first gas duct is arranged in a central body extending coaxially to the injector longitudinal axis within the second gas duct, wherein the gas fuel transfer line(s) extends/extend radially through the second gas duct and wherein, in particular, further support elements and/or second swirl elements for holding the central body are arranged extending radially within the second gas duct. The gas fuel transfer line(s) and/or further support elements and/or second swirl elements are distributed equidistantly to one another in the second gas duct, particularly in the circumferential direction. The support elements and/or other second swirl elements preferably have a smaller flow cross-section than the gas fuel transfer line(s). The gas fuel ring reservoir and/or the liquid fuel ring reservoir is/are arranged in particular radially on the outside around the second gas duct in the injector assembly.

It is conducive to a low pressure loss within the injector assembly if the gas fuel transfer line(s) in the second gas duct are shaped and/or clad (e.g. by means of a casing) in a flow-optimized manner, wherein the gas fuel transfer line can be designed to act in particular as a second swirl element, in each case as applicable (i.e. if a plurality of gas fuel transfer lines are provided).

A uniform introduction of the liquid fuel into the combustion chamber, without interruption during the changeover between the configurations, can be ensured if the liquid fuel injection is arranged radially outside around the second gas duct and is designed to introduce the liquid fuel at the downstream end of the second gas duct, into an air flow flowing through and/or emerging from the second gas duct, in particular by means of at least one liquid fuel outlet opening at the downstream end of the second gas duct. In particular, the liquid fuel outlet opening can be annular at least in portions and designed as a single outlet opening and/or comprise several discrete outlet openings.

For a favourable flow characteristic, at least a third gas duct and preferably a fourth gas duct are arranged radially around the outside of the liquid fuel injection, wherein the third gas duct is designed as a radially outer air duct and, as applicable, the fourth gas duct is designed as the radially outermost air duct.

In the aircraft, it is provided that the aircraft comprises at least one engine comprising an injector assembly according to one of the preceding claims, and a fuel peripheral comprising at least one respective tank device for gaseous fuel and for liquid fuel and line means for conducting the gaseous fuel and the liquid fuel from the respective tank device to the injector assembly, wherein at least one fuel valve for controlling the gaseous fuel and the liquid fuel is arranged in the line means in each case, wherein the injector assembly assumes a first configuration when the fuel valve for gaseous fuel is closed, with interruption of the flow of gaseous fuel, and the injector assembly assumes a second configuration when the fuel valve for gaseous fuel is opened.

Figure 2:
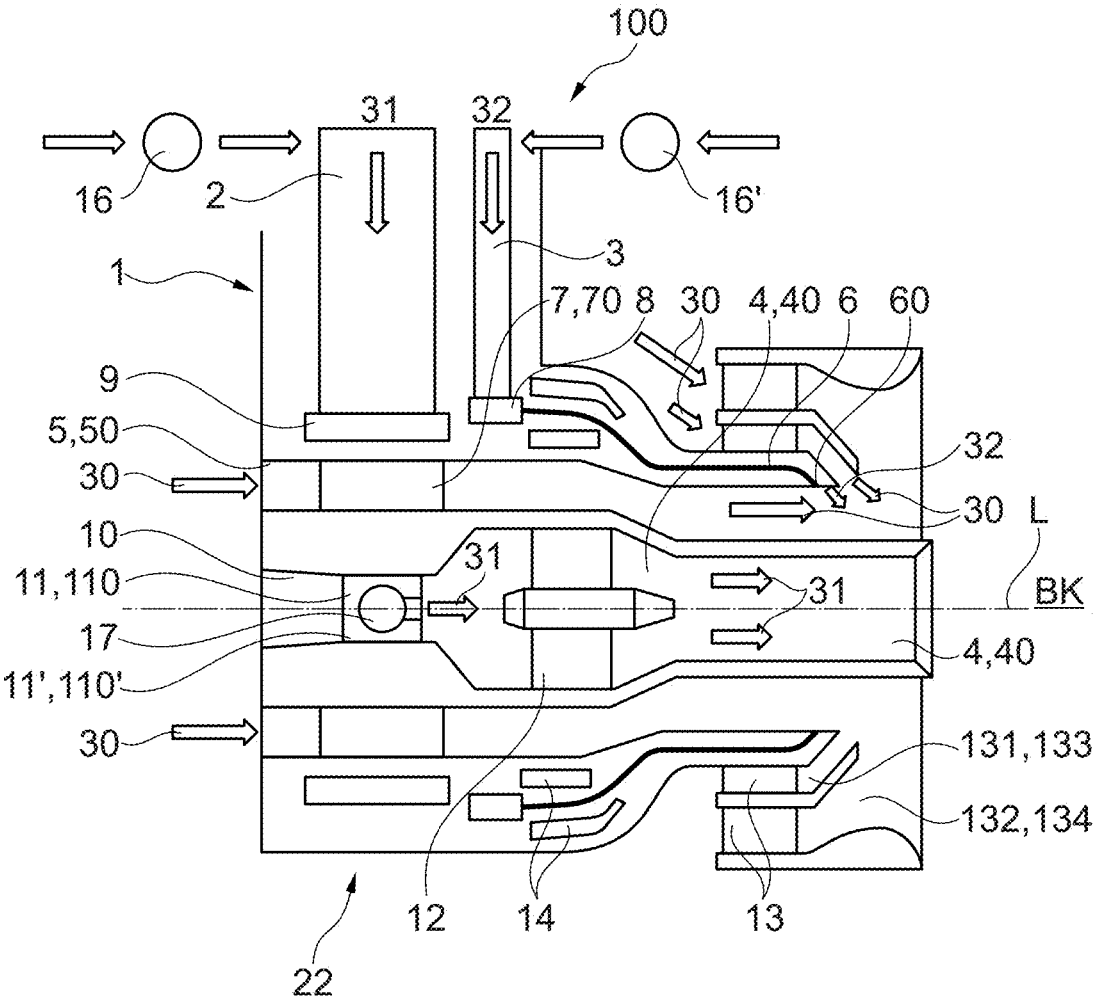
Figure 3:
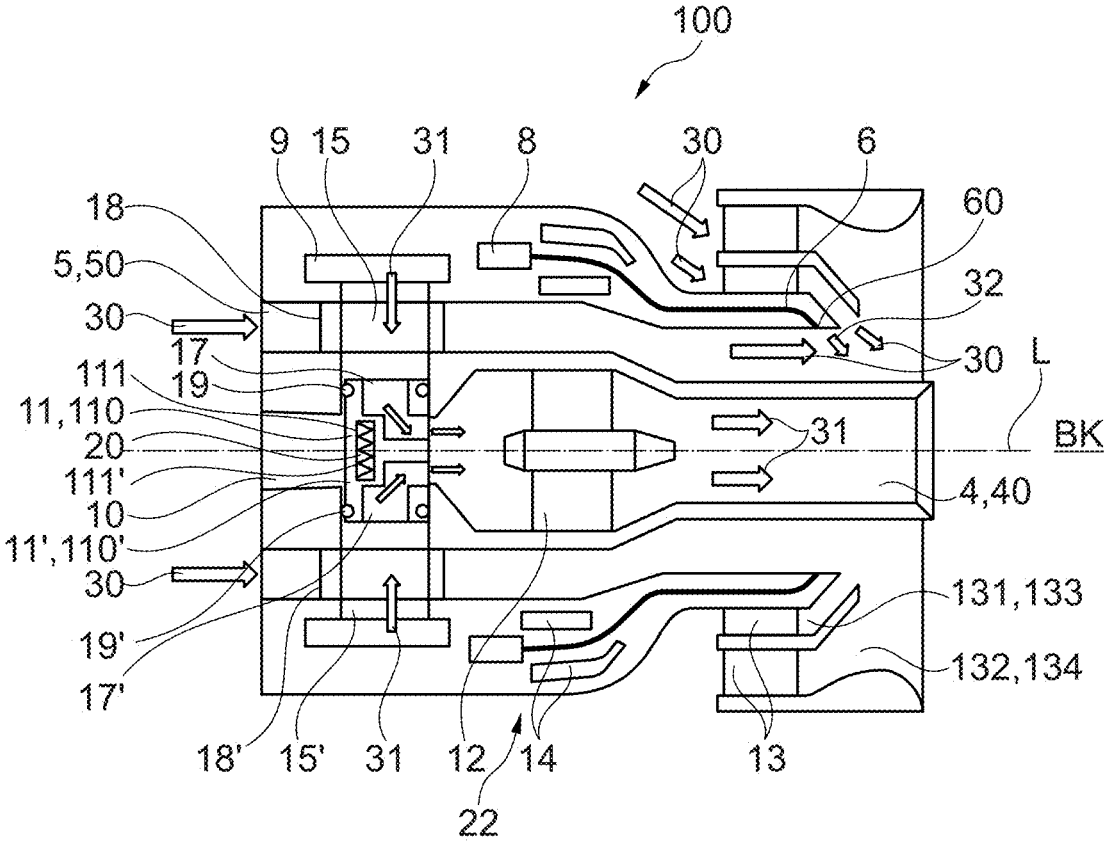
Figure 4:
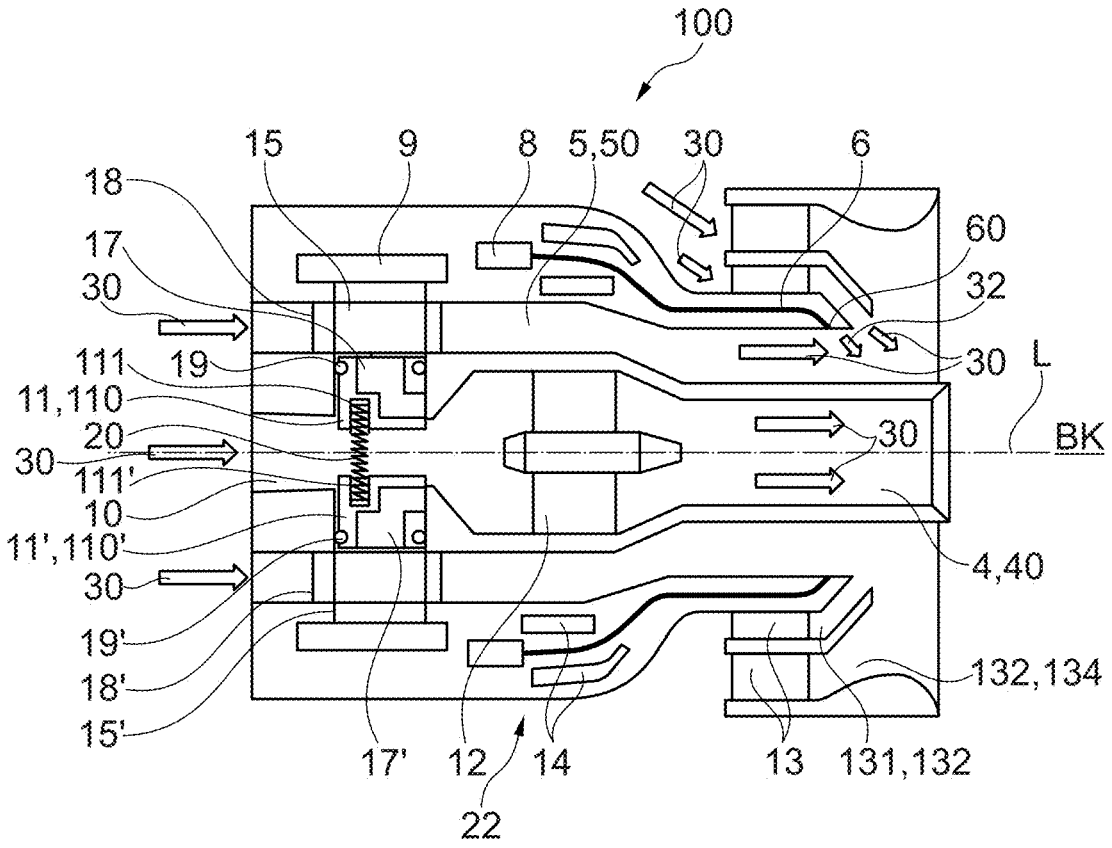
Figure 5:
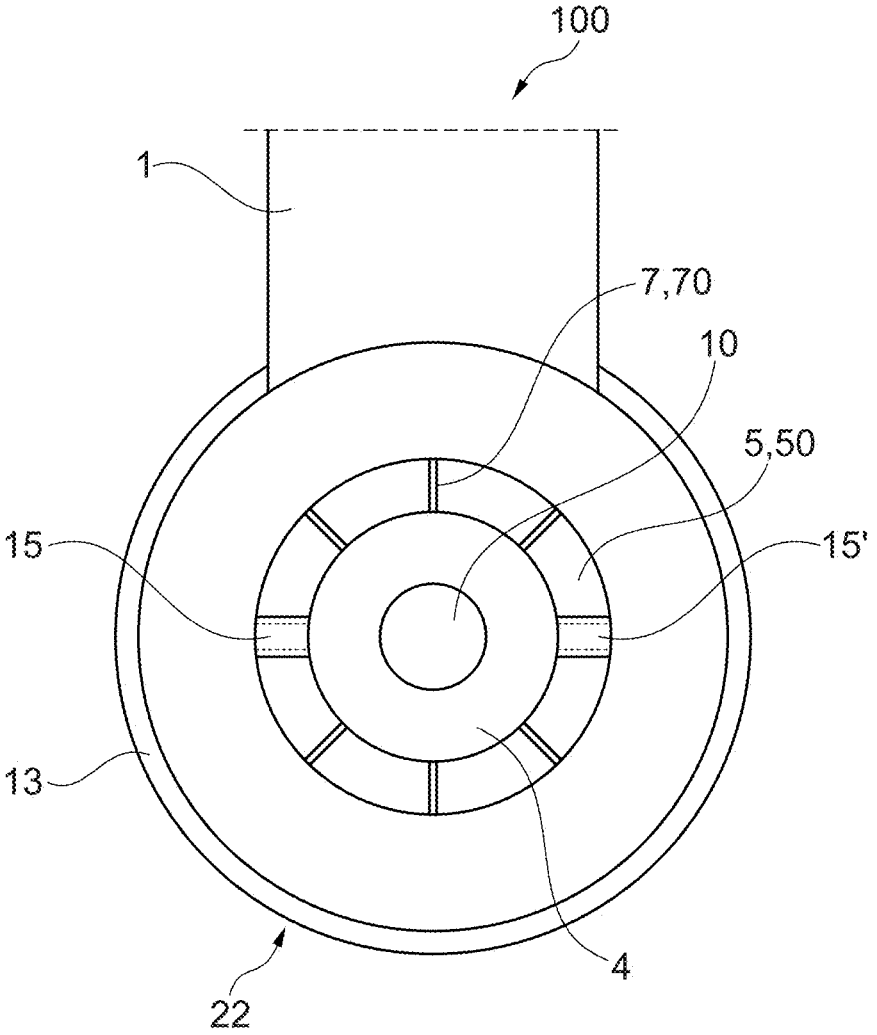
Figure 6:
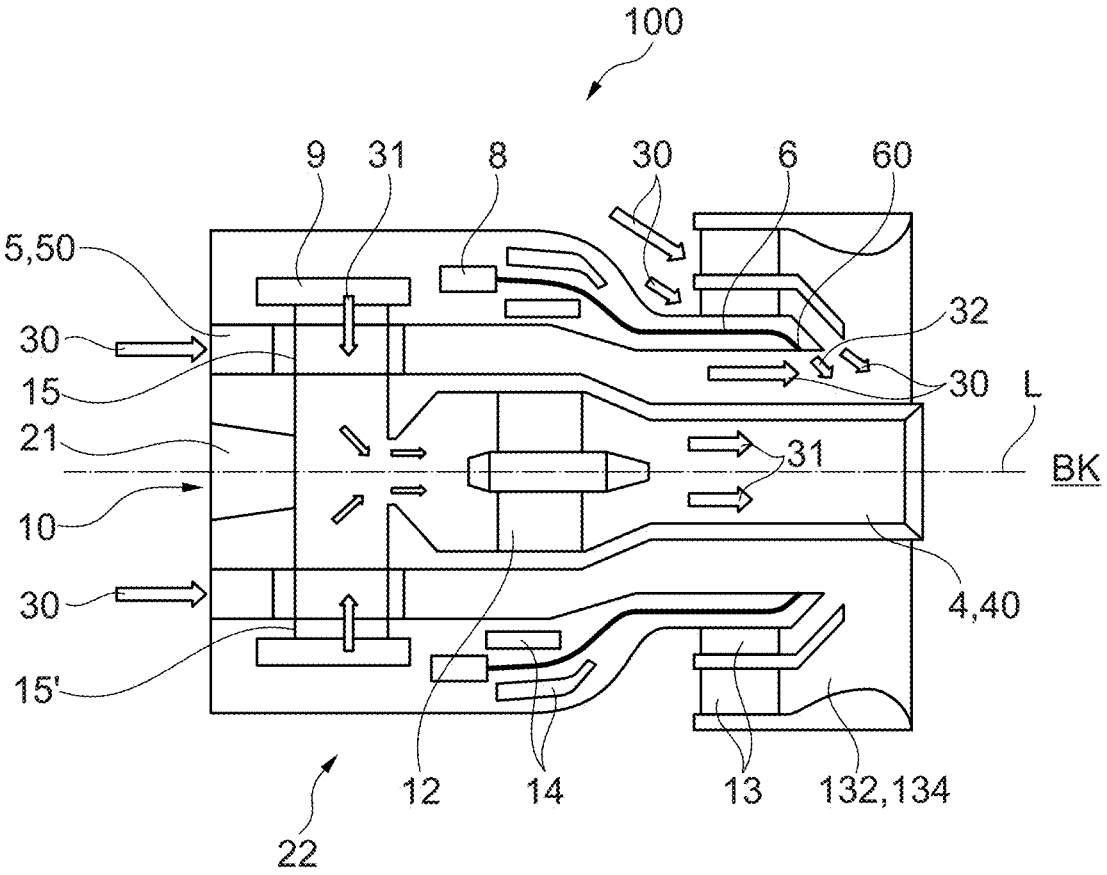

The invention will be explained in more detail in the following text by way of exemplary embodiments with reference to the drawings, in which:

FIG. 1 shows an injector assembly according to the invention for introducing a gaseous fuel and a liquid fuel into a combustion chamber of an engine, in a first configuration, shown schematically in a longitudinal section along an injector longitudinal axis, FIG. 2 shows a schematic representation of the injector assembly in a second configuration in a longitudinal section along an injector longitudinal axis, FIG. 3 shows the injector assembly in the second configuration in a longitudinal section rotated by 90° about the injector longitudinal axis compared to FIG. 2, FIG. 4 shows the injector assembly in the first configuration in the view according to FIG. 3, FIG. 5 shows a plan view of the injector assembly looking towards the combustion chamber, and FIG. 6 shows a further variant of the injector assembly, with a non-adjustable closure element, in the view shown according to FIG. 3.

FIG. 1 shows a schematic longitudinal sectional view of an injector assembly 100 for introducing fuel and air 30 into a combustion chamber BK of an engine, in particular of an aircraft. The injector assembly 100 has an injector shaft 1 and an injector main body 22 arranged on the injector shaft 1. The injector main body 22 is aligned along an injector longitudinal axis L running at an angle, in this case substantially at right angles, to the injector shaft 1.

The injector assembly 100 is set up for operation with two types of fuel, a gaseous fuel 31 and a liquid fuel 32. The fuels can be fed to the injector assembly 100 both simultaneously (in parallel) in a combined operation and individually, in a separate operation of liquid and/or gaseous fuel. Both a gas fuel supply line 2 and a liquid fuel supply line 3 are arranged in the injector shaft 1 for the fuel supply line. In FIG. 1, the two fuel supply lines 2 and 3 are routed parallel to each other as an example.

The gaseous fuel 31 is formed in particular from hydrogen and/or comprises hydrogen. The liquid fuel 32 is formed in particular by kerosene and/or a sustainable alternative fuel (SAF).

The aircraft has a correspondingly equipped fuel peripheral, which comprises at least one tank device each for gaseous fuel 31 and liquid fuel 32 (not shown in FIG. 1). In addition, line means are provided for conducting the gaseous fuel 31 and the liquid fuel 32 to the injector assembly 100. A fuel valve 16, 16' (see FIG. 2) for controlling the gaseous fuel 31 and the liquid fuel 32 is arranged in each of the line means.

To supply the liquid fuel 32, the injector assembly 100 preferably has a liquid fuel ring reservoir 8 at the downstream end of the liquid fuel supply line 3. Starting from the liquid fuel ring reservoir 8, a liquid fuel injection 6 is routed within the injector main body 22 to a downstream end portion of the injector main body 22. The liquid fuel injection 6 has, for example, discrete fuel ducts and/or at least in portions a radially circumferential, continuous fuel ring duct (not shown here in more detail). In addition, the liquid fuel injection 6 can be designed in particular by means of swirl elements for swirling the liquid fuel 32 (not shown here). Preferably, heat shields 14 can be provided to shield the fuel ducts of the liquid fuel injection 6 against high heat input, for example from surrounding air ducts. At the downstream end portion, the liquid fuel injection 6 has at least one liquid fuel outlet opening 60, wherein several discrete openings or a circumferential ring opening may be present.

The injector assembly 100 comprises a first gas duct 40, which is arranged centrally on the injector longitudinal axis L and which is designed and arranged to introduce a central gas flow into the combustion chamber BK. In the first gas duct 40, a flow body 12 with swirl elements can be arranged centrally on the injector longitudinal axis L in order to impose a circumferential swirl on the central gas flow.

In particular, a second gas duct 5 is arranged radially around the first gas duct 40 as an air duct 50 (i.e. without an intermediate arrangement of a further fluid duct). The upstream end of the air duct 50 is positioned, for example, at least substantially at the level of the upstream end of the air inflow opening 10. The at least one liquid fuel outlet opening 60 for injecting the liquid fuel 32 into the air stream flowing through the second air duct 50 is arranged at the downstream end of the air duct 50.

The first gas duct 40 is preferably arranged in a central body 4 extending coaxially to the injector longitudinal axis L within the second gas duct 5. The central body 4 is held and/or fastened in the second gas duct 5, for example by means of radially extending support elements 7 (for example four to eight in number). In particular, the support elements 7 can be designed at least partially as second swirl elements 70 and/or as gas fuel transfer lines 15, 15' (see FIG. 3).

An annular gas fuel ring reservoir 9, into which the gas fuel supply line 2 opens, is arranged radially around the second gas duct 5 in the injector main body 22. In particular, the gas fuel ring reservoir 9 is positioned at a greater axial distance from the combustion chamber BK than the liquid fuel ring reservoir 8.

Preferably, outer gas ducts, for example two gas ducts, a third gas duct 131 and a fourth gas duct 132 running radially around the outside of the third gas duct 131 are arranged in the downstream end portion of the injector main body 22, running radially around the outside of the liquid fuel injection 6. The outer gas ducts 131, 132 form an outer air duct 133 and an outermost air duct 134.

According to the invention, the injector assembly 100 is designed such that it can be switched between two configurations during operation: a first configuration, wherein the central, first gas duct 40 is assigned a function as an air injection, wherein air 30 flows through the first gas duct 40 during operation, and a second configuration, wherein the central, first gas duct 40 is assigned a function as a gas fuel injection, wherein the first gas duct 40 is flowed through with the gaseous fuel 31 (and not with air 30) during operation. In this way, the injector assembly 100 can be advantageously operated both in the combined mode and in the separate mode with a flow passing through the central, first gas duct 40, wherein "idling" of the first gas duct 40 and associated disadvantages (e.g. overheating, formation of soot, etc.) are avoided. The central flow contributes to extremely favourable emission characteristics, with low nitrogen oxide emissions ($NO_x$).

A further gas fuel injection, in addition to the first gas duct 40 in the second configuration, is preferably not present on the injector assembly 100.

In the first configuration, in particular the gaseous fuel 31 does not flow through the injector assembly 100 and therefore no gaseous fuel 31 is fed into the combustion chamber BK. The first configuration is thus intended for separate operation with liquid fuel 32.

In the second configuration, in particular the gaseous fuel 31 flows through the injector assembly 100, and air also flows through at least the second gas duct 5. Liquid fuel 32 can optionally flow through the liquid fuel injection 6. The second configuration is thus intended for combined operation or separate operation with the gaseous fuel 31.

FIG. 1 shows the injector assembly 100 in the first configuration, wherein the first gas duct 40 acts as an air injection. For this purpose, the first gas duct 40 comprises an air inflow opening 10 in an upstream end portion. The air inflow opening 10, like the rest of the gas duct 40, is arranged centrally on the injector longitudinal axis L. In particular, the air inflow opening 10 closes axially on the upstream side with the upstream end of the injector main body 22 facing away from the combustion chamber BK. Air can only flow through the upstream end portion with the air inflow opening 10.

In the first configuration, as shown in FIG. 1, the air inflow opening 10 is open, wherein the air inflow opening 10 is in flow connection with a portion of the first gas duct 40 adjacent to the combustion chamber BK. Thus, in the first configuration, air 30 flows into the first gas duct 40 via the air inflow opening 10 and through the same into the combustion chamber BK. Gaseous fuel 31 is not supplied to the combustion chamber BK.

FIG. 2 shows the injector assembly 100 in the second configuration, wherein the first gas duct 40 acts as a gas fuel injection. The air inflow opening 10 is closed by means of at least one closing body 11 arranged inside the first gas duct 40, in particular directly downstream of the air inflow opening 10. In the example shown in FIG. 2, there are two closing bodies 11, 11' in the form of pistons 110, 110', as described in more detail below in conjunction with FIG. 3 and FIG. 4. Here, "closed" means that the flow connection to the portion of the first gas duct 40 adjacent to the combustion chamber BK is interrupted, wherein the exemplary two closing bodies 11, 11' are positioned at least substantially flow-tight in the air inflow opening 10 and/or (in particular directly) downstream thereof, extending radially and centrally in the gas duct 40.

The first gas duct 40 can advantageously have the smallest flow cross-section, in particular the smallest diameter, at the axial position of the closing bodies 11, 11'. In this way, the radial extent of the closing bodies 11, 11' can be kept to a minimum and the inflow opening 11, 11' can be used to introduce the closing bodies 11, 11'.

To feed the gaseous fuel 32 from the gas fuel ring reservoir 9 into the first gas duct 40, two gas fuel transfer lines 15, 15' are provided within the injector main body 22 as an example (see FIG. 3). The gas fuel transfer lines 15, 15' extend radially between the gas fuel ring reservoir 9 and the first gas duct 40 through the second gas duct 5. The gas fuel transfer lines 15, 15' can preferably each have a flow-optimized (aerodynamically) shaped wall 18, 18' and/or be shaped in a flow-optimized manner to reduce the flow resistance within the second gas duct 5. As FIG. 3 shows, the gas fuel transfer lines 15, 15' are arranged opposite each other, in particular in the direction of rotation, for example at a position of 90° and 270° with respect to the injector shaft 1. The gas fuel transfer lines 15, 15' can in particular additionally serve as a support for the central body 4 in the function of the support elements 7, wherein they are arranged equidistantly to one another in the direction of rotation together with the (other) support elements 7 and/or swirl elements 70 (see also FIG. 5).

FIG. 3 shows in more detail the design and arrangement of the closing bodies 11, 11' in a longitudinal sectional view of the injector assembly 100 rotated by 90° about the injector longitudinal axis L compared with FIG. 2. As FIG. 3 shows, in the second configuration the closing bodies 11, 11' project from the gas fuel transfer lines 15, 15' into the centre of the first gas duct 40 and are in sealing contact with each other along the injector longitudinal axis L with respect to the air flowing against the injector main body 22. This closes the air inflow opening 10.

Closing body ducts 17, 17' are formed within the closing bodies 11, 11' and in the second configuration form a flow connection from the gas fuel transfer lines 15, 15' into the first gas duct 40. The closing body ducts 17, 17' are aligned in particular with a first portion on the upstream side parallel to the gas fuel transfer lines 15, 15' and with a second portion on the downstream side parallel to the injector longitudinal axis L. Circumferential sealing means 19, 19' are preferably provided to seal the closing bodies 11, 11' with respect to the gas fuel transfer lines 15, 15'. The closing bodies 11, 11' are mounted in the gas fuel transfer lines 15, 15' so that they can be moved radially opposite each other. The flow cross-section of the closing body ducts 17, 17' is sufficiently large in total to ensure that the gaseous fuel 31 flows into the gas duct 40 with as little pressure loss as possible. By means of the arrangement and design of the two closing bodies 11, 11' exemplified here, the gas fuel transfer lines 15, 15' and the closing body ducts 17, 17' are open for flow in the second configuration.

To switch between the first and second configuration, FIG. 3 shows at least one resilient actuating element 20, e.g. in the form of a compression spring, which is attached at one end to each of the closing bodies 11, 11'. In the second configuration shown in FIG. 3, the actuating element 20 is pushed together against the radially outwardly acting spring force, wherein the gaseous fuel applies an opposing, radially inwardly directed pressure force, which overcomes the spring force and causes the closing bodies 11, 11' to be pressed together until they make contact on the injector longitudinal axis L.

The actuating element 20 is fastened and guided in elongate recesses 111, 111' provided within the closing bodies 11, 11' in such a way that the closing bodies 11, 11' can be in contact with each other centrally on the injector longitudinal axis L. The recesses 111, 111' are preferably in the same axial position and point with their openings radially in the direction of the injector longitudinal axis L, wherein in the illustrated pushed-together position of the closing bodies 11, 11' they together form a cavity for receiving the actuating element 20.

FIG. 4 shows the arrangement of the closing bodies 11, 11' in the first configuration in the view of the injector assembly 100 corresponding to FIG. 3. The closing bodies 11, 11' are displaced and/or inserted radially outwards into the gas fuel transfer lines 15, 15', closing the gas fuel transfer lines 15, 15' and opening the air inflow opening 10. The closing body ducts 17, 17' of the two closing bodies 11, 11' are closed by means of the inner walls of the gas fuel transfer lines 15, 15' so that the gaseous fuel 31 cannot flow through them, wherein the downstream end of the second portion of the closing body ducts 17, 17' in each case rests against the inner wall of the gas fuel transfer lines 15, 15'.

Switching from the second configuration to the first configuration is done by closing the fuel valve 16 of the gaseous fuel 31 (see FIG. 2). This eliminates the pressure force applied by the gaseous fuel 31. As a result, the two closing bodies 11, 11' are pressed radially apart into the gas fuel transfer lines 15 by the spring force applied by the actuating element 20. In this way, the air inflow opening 10 is released. The first configuration thus forms a resting state in which the actuating element is in the resting position without counteracting the pressure force.

The changeover from the first configuration to the second configuration takes place by opening the fuel valve 16 of the gaseous fuel 31 (see FIG. 2), whereby the pressure force acts on the two closing bodies 11, 11' and presses them together.

FIG. 5 shows a plan view of the injector assembly 100 looking towards the combustion chamber BK, showing an exemplary arrangement of the support elements 7 and/or second swirl elements 70 and the gas fuel transfer lines 15, 15' in the second gas duct 5. For example, a total of eight support elements 7 and/or swirl elements 70 including the gas fuel transfer lines 15, 15' are provided. To reduce the flow resistance, the support elements 7 and/or swirl elements 70 preferably have a smaller cross-section than the gas fuel transfer lines 15, 15'.

FIG. 6 shows a possible variant of the injector assembly 100 for an operating scenario with permanently flowing gaseous fuel. The air inflow opening 10 is permanently closed by means of a closure 21 that does not move during operation.

The proposed injector assembly 100 advantageously enables extremely low-emission operation within different operating scenarios with different fuels.

LIST OF REFERENCE SIGNS

1 injector shaft
100 injector assembly
2 gas fuel supply line
3 liquid fuel supply line
4 central body
40 first gas duct
5 second gas duct

50 air duct
6 liquid fuel injection
60 liquid fuel outlet opening
7 support element
70 second swirl element
8 liquid fuel ring reservoir
9 gas fuel ring reservoir
10 inflow opening
11, 11' closing body
110, 110' piston
111 recess
12 flow body
13 swirl elements
131 third gas duct
132 fourth gas duct
133 outer air duct
134 outermost air duct
14 heat shield
15, 15' gas fuel transfer line
16, 16' fuel valve
17, 17' closing body duct
18, 18' wall
19, 19' sealing means
20 actuating element
21 closure
22 injector main body
30 air
31 gaseous fuel
32 liquid fuel
BK combustion chamber
L injector longitudinal axis

The invention claimed is:

1. An injector assembly for a gas turbine, configured for introducing a gaseous fuel and a liquid fuel and air into a combustion chamber, comprising:

an injector shaft, and an injector main body aligned along an injector longitudinal axis, wherein the injector main body comprises:

a first gas duct arranged centrally on the injector longitudinal axis to include the longitudinal axis, for introducing a flow of the gaseous fuel or a flow of air into the combustion chamber, at least one air duct arranged radially around an outside of the first gas duct, and a liquid fuel injector arranged radially around the first gas duct for introducing the liquid fuel into the combustion chamber, wherein the injector assembly is also configured to introduce the gaseous fuel, wherein the injector assembly is configured to adopt two, alternative configurations between which the injector assembly can be switched during operation, wherein in a first configuration air flows through the first gas duct, as an air injection, and in a second configuration the gaseous fuel flows through the first gas duct as a gas fuel injection;

a gas fuel ring reservoir arranged downstream of the gas fuel supply line;

wherein the first gas duct comprises, in an upstream end portion, an air inflow opening, which is arranged centrally on the injector longitudinal axis to include the longitudinal axis, and at least one gas fuel transfer line arranged within the injector main body and extending radially between the gas fuel ring reservoir and the first gas duct, wherein, in the first configuration the gas fuel transfer line(s) is/are closed and in the second configuration the air inflow opening is closed.

2. The injector assembly according to claim 1, and further comprising at least one closing body for switching between the first and second configurations, the at least one closing body being configured such that:

in the first configuration, each of the at least one closing body is radially displaced into a respective one of the at least one gas fuel transfer line to close the respective one of the at least one gas fuel transfer line while opening the air inflow opening; and in the second configuration, the at least one closing body is positioned radially centrally, in or downstream of the air inflow opening, in the first gas duct to close the air inflow opening while opening the respective one of the at least one gas fuel transfer line.

3. The injector assembly according to claim 2, and further comprising:

a closing body duct for each of the at least one closing body, for the gaseous fuel to flow through, each closing body duct being arranged so that the flow of gaseous fuel cannot pass through the closing body duct in the first configuration and the flow of gaseous fuel can pass through the closing body duct in the second configuration, by the positioning of the respective one of the at least one closing body.

4. The injector assembly according to claim 3, and further comprising at least one resilient actuating element for switching between the first and second configurations, the at least one resilient actuating element performing the switch between the first configuration and the second configuration by a spring force in interaction with a compressive force applied by the gaseous fuel.

5. The injector assembly according to claim 4, wherein the first configuration forms a rest state in which the at least one resilient actuating element is in a rest position without counteraction of the compressive force; and in the second configuration, the at least one resilient actuating element is adjusted by counteracting the compressive force.

6. The injector assembly according to claim 5, wherein the at least one resilient actuating element is arranged to act on each of the at least one closing body.

7. The injector assembly according to claim 6, wherein the at least one closing body includes two closing bodies and the at least one gas fuel transfer line includes two gas fuel transfer lines arranged opposite one another across the first gas duct with respect to the injector longitudinal axis, wherein each of the at least one resilient actuating element is fastened at one end to one of the two closing bodies, wherein, in the first configuration, the two closing bodies are pushed apart radially into the two gas fuel transfer lines by the at least one resilient actuating element, releasing the air inflow opening, and/or wherein, in the second configuration, the two closing bodies are radially compressed by the compressive force of the gaseous fuel against the spring force of the at least one resilient actuating element, such that the two closing bodies are positioned centrally within the first gas duct in contact with one another.

8. The injector assembly according to claim 2, wherein the first gas duct has a smallest flow cross-section at an axial position of the at least one closing body.

9. The injector assembly according claim 1, wherein the air duct is formed as a second gas duct running radially directly around the first gas duct, wherein an upstream end of the second gas duct is positioned at, or upstream of, an axial position of an upstream end of the air inflow opening.

10. The injector assembly according to claim 9, wherein the first gas duct is arranged in a central body extending coaxially to the injector longitudinal axis within the second gas duct, and further comprising:

the at least one gas fuel transfer line connecting the gas fuel supply line and the first gas duct, the at least one gas fuel transfer line extending radially through the second gas duct, and further support elements and/or swirl elements extending radially within the second gas duct to hold the central body.

11. The injector assembly according to claim 10, wherein the at least one gas fuel transfer line in the second gas duct is shaped and/or clad in a flow optimized manner, wherein the at least one gas fuel transfer line is configured as an additional swirl element.

12. The injector assembly according to claim 9, wherein the liquid fuel injector is arranged radially on the outside around the second gas duct and is configured for introducing the liquid fuel at a downstream end of the second gas duct, into an air flow flowing through the second gas duct and/or emerging therefrom, by at least one liquid fuel outlet opening, opening at the downstream end of the second gas duct.

13. The injector assembly according to claim 1, wherein the air duct is formed as a second gas duct, and further comprising a third gas duct, and a fourth gas duct, which are arranged radially around the liquid fuel injector, wherein the third gas duct is configured as a radially outer air duct and the fourth gas duct is configured as a radially outermost air duct.

14. An aircraft having at least one engine comprising the injector assembly according to claim 1, and having a fuel peripheral comprising at least one tank device for each of the gaseous fuel and the liquid fuel from the respective at least one tank device to the injector assembly, and further comprising at least one fuel valve for controlling the gaseous fuel arranged in the gaseous fuel line and at least one fuel valve for controlling the liquid fuel arranged in the liquid fuel line, wherein when the at least one fuel valve for the gaseous fuel is closed, with interruption of the flow of the gaseous fuel, the injector assembly assumes the first configuration and when the at least one fuel valve for the gaseous fuel is opened, the injector assembly assumes the second configuration.

15. The injector assembly to claim 1, wherein the first configuration, the gaseous fuel is prevented from flowing through the first gas duct, and while in the second configuration, air is prevented from flowing through the first gas duct.

16. The injector assembly to claim 10, wherein in the first configuration, the gaseous fuel is prevented from flowing through the first gas duct, and while in the second configuration, air is prevented from flowing through the first gas duct.

17. An injector assembly for a gas turbine, configured for introducing a gaseous fuel and a liquid fuel and air into a combustion chamber, comprising:

an injector shaft, and an injector main body aligned along an injector longitudinal axis, wherein the injector main body comprises:

a first gas duct arranged centrally on the injector longitudinal axis and including the longitudinal axis, for introducing a flow of the gaseous fuel or a flow of air into the combustion chamber, at least one air duct arranged radially around an outside of the first gas duct, and a liquid fuel injector arranged radially around the first gas duct for introducing the liquid fuel into the combustion chamber, wherein the injector assembly is also configured to introduce the gaseous fuel, wherein the injector assembly is configured to adopt two alternative configurations between which the injector assembly can be switched during operation, wherein in a first configuration air flows through the first gas duct, as an air injection, and in a second configuration the gaseous fuel flows through the first gas duct as a gas fuel injection;

wherein the air duct is formed as a second gas duct running radially directly around the first gas duct, wherein an upstream end of the second gas duct is positioned at, or upstream of, an axial position of an upstream end of an air inflow opening at an upstream end of the first gas duct;

wherein the first gas duct is arranged in a central body extending coaxially to the injector longitudinal axis within the second gas duct;

at least one gas fuel transfer line connecting a gas fuel supply line and the first gas duct, the at least one gas fuel transfer line extending radially through the second gas duct, and further support elements and/or swirl elements extending radially within the second gas duct to hold the central body.

18. The injector assembly according to claim 17, wherein in the first configuration, the gaseous fuel is prevented from flowing through the first gas duct, and while in the second configuration, air is prevented from flowing through the first gas duct.

* * * * *